US011255095B2

(12) United States Patent
Rogers

(10) Patent No.: US 11,255,095 B2
(45) Date of Patent: Feb. 22, 2022

(54) MODIFIED LEDGER AND MODULAR SCAFFOLD SYSTEM WITH CONTINUOUS WORK SURFACE

(71) Applicant: AT-PAC CHINA BUSINESS TRUST, Luxembourg (LU)

(72) Inventor: Peter Rogers, Jiangsu (CN)

(73) Assignee: AT-PAC CHINA BUSINESS TRUST, Luxembourg (LU)

( * ) Notice: Subject to any disclaimer, the term of this patent is extended or adjusted under 35 U.S.C. 154(b) by 115 days.

(21) Appl. No.: 16/611,341

(22) PCT Filed: May 8, 2018

(86) PCT No.: PCT/EP2018/061766
§ 371 (c)(1),
(2) Date: Nov. 6, 2019

(87) PCT Pub. No.: WO2018/206525
PCT Pub. Date: Nov. 15, 2018

(65) Prior Publication Data

US 2020/0080324 A1 Mar. 12, 2020

Related U.S. Application Data

(60) Provisional application No. 62/503,604, filed on May 9, 2017.

(51) Int. Cl.
*E04G 7/32* (2006.01)
*E04G 1/04* (2006.01)
*E04G 1/15* (2006.01)

(52) U.S. Cl.
CPC ..... *E04G 7/32* (2013.01); *E04G 1/04* (2013.01); *E04G 1/152* (2013.01)

(58) Field of Classification Search
CPC .... E04G 7/32; E04G 7/02; E04G 1/04; E04G 1/152; E04G 1/02
See application file for complete search history.

(56) References Cited

U.S. PATENT DOCUMENTS 2,845,307 A * 7/1958 Holmes ..... E04G 7/308 403/49
2,889,157 A * 6/1959 Gibbons ..... E21B 21/01 285/81

(Continued)

FOREIGN PATENT DOCUMENTS

CA 2743832 A1 12/2012
CN 1255179 A 5/2000

(Continued)

OTHER PUBLICATIONS

Search Report and Written Opinion for International Patent Application No. PCT/EP2018/061766; dated Jun. 22, 2018.

(Continued)

*Primary Examiner* — Alvin C Chin-Shue
*Assistant Examiner* — Shiref M Mekhaeil
(74) *Attorney, Agent, or Firm* — Barnes & Thornburg LLP

(57) ABSTRACT

A scaffold ledger providing a raised support surface of the elongate structural member with the opposed ledger heads being downwardly and outwardly offset. Each ledger head includes cover flaps that extend the raised support surface above the ledger heads in a cover position. The scaffold ledger cooperates with scaffold posts and scaffold planks to allow for a continuous work platform above an intermediate scaffold support post and/or across supporting ledgers.

12 Claims, 11 Drawing Sheets

(56) References Cited

U.S. PATENT DOCUMENTS 3,266,208 A * 8/1966 Maggs ..... E04G 1/152 52/651.1
4,188,143 A * 2/1980 Matsuura ..... E04G 7/305 403/317
4,194,849 A * 3/1980 Matsuura ..... E04G 7/305 403/317
5,395,140 A * 3/1995 Wiethorn ..... F16L 37/0985 285/320
5,437,648 A * 8/1995 Graves ..... A61M 39/1011 604/192
5,628,531 A * 5/1997 Rosenberg ..... F16L 37/0985 285/319
5,868,223 A * 2/1999 Lubinski ..... E04G 7/32 182/179.1
5,961,240 A * 10/1999 Bobrovniczky ..... E04G 7/32 403/49
6,672,792 B1 * 1/2004 Schipani ..... F16B 7/042 285/320
8,789,854 B2 * 7/2014 Christian, Jr. ..... F16L 37/082 285/320
8,931,594 B2 * 1/2015 Kreller ..... E04G 7/22 182/186.8
8,973,711 B2 * 3/2015 Hayman ..... E04G 7/304 182/186.8
9,671,052 B2 * 6/2017 Bippus ..... F16L 37/101
2013/0330117 A1 * 12/2013 Kreller ..... E04G 7/02 403/49
2014/0086669 A1 * 3/2014 Rogers ..... E04G 1/14 403/231
2016/0281375 A1 * 9/2016 Rogers ..... E04G 7/34
2018/0148942 A1 * 5/2018 Lindberg ..... E04G 7/308
2018/0251989 A1 * 9/2018 Rogers ..... E04G 1/14
2019/0390470 A1 * 12/2019 Rogers ..... E04G 5/08

FOREIGN PATENT DOCUMENTS

CN 1662717 A1 8/2005
WO 2013055280 A1 4/2013

OTHER PUBLICATIONS

Chinese Official Action dated Feb. 24, 2021 issued in connection with Chinese Patent Appln No. 201880038026.1; 8 pages.

* cited by examiner

MODIFIED LEDGER AND MODULAR SCAFFOLD SYSTEM WITH CONTINUOUS WORK SURFACE

PRIORITY CLAIM

This patent application is a U.S. National Phase of International Patent Application No. PCT/EP2018/061766, filed May 8, 2018, which claims priority to U.S. Provisional Patent Application No. 62/503,604, filed May 9, 2017, the disclosures of which are incorporated herein by reference in their entireties.

FIELD OF THE INVENTION

The present invention relates to scaffolding systems and, in particular, to a scaffold ledger member where the elongate connecting member between two ledger heads has been offset and positioned to one side of the ledger heads.

BACKGROUND OF THE INVENTION

Scaffolding systems having releasable ledgers are well known and there are several different mechanical fastening arrangements are used to connecting the ledger heads to a securing member of a scaffold post. One of these fastening arrangements utilizes securing rosettes on scaffold posts, in combination with the ledger heads, have a securing slot and displaceable wedge for engaging rosettes. A further popular system is a cup fastening system where a portion of the ledger head is received in a cup fastener of the scaffold post.

With these systems, scaffold ledgers are easily connected and disconnected from scaffold posts using connecting components fixed to the scaffold posts at predetermined points in the length of the scaffold post.

In many scaffolding applications, it is desirable to provide a continuous work platform that is not interrupted by intermediate scaffold posts located below the work platform. In continuous work platforms, a portion of each ledger along a side of an adjacent scaffold plank may be partially covered by a projecting edge of the scaffold plank. This arrangement reduces gaps and trip hazards associated with intermediate ledgers immediately below the work platform.

The present invention seeks to overcome problems associated with existing systems in providing a continuous work platform.

One of the problems associated with existing scaffold ledgers is with respect to a fastening wedge which is movable downwardly through the ledger head to engage and fasten the ledger head either side of a securing rosette. The wedge can be moved to a release position allowing the ledger head to be placed on or removed from a securing rosette. The wedge is movable downwardly through the ledger head to a locked position securing ledger head on a rosette. With this conventional arrangement, the wedge in a locked position projects above the upper surface of the longitudinal member of the ledger. The projecting top portion of the wedge, in the locked position, presents a trip hazard with respect to the work platform that is ultimately defined by scaffold planks supported on the ledgers.

SUMMARY OF THE INVENTION

A scaffold ledger, according to the present invention, comprises two ledger heads located at opposite ends of an elongate structural member that extends between and is mechanically secured to each ledger head. Each ledger head includes a projecting support member for engaging a support member of a scaffold post and the projecting support member is downwardly offset relative to said elongate structural member. An upwardly angled rear support member of the ledger head connects with said elongate structural member at a position inwardly of said projecting support member to provide a clear area thereabove.

According to an aspect of the invention, each ledger head includes a displaceable wedge movable from a raised clear position allowing positioning of the scaffold ledger for engaging a scaffold post connection to a locked position extending through said ledger hear to retain said ledger head on a scaffold post with a top drive surface of said wedge below an upper surface of said elongate member.

In an aspect of the invention, each ledger head includes a pivoting cover cap movable from a first position extending a top surface of said elongate structural member over said projecting support member to a raised position providing top down access to said projecting support member.

A scaffold ledger, according to an aspect of the invention, comprises two ledger heads located at opposite end of an elongate horizontal member extending between and being mechanically secured to each ledger head. Each ledger head comprises a support portion for coupling to a structural member of a scaffold post, a body extending inwardly and upwardly from said support portion coupling one end of said horizontal member at a position above said support portion; and a pivoting cover movable between a raised position providing top down access to said support portion and a working position wherein a top surface of said cover is generally aligned with a top surface of said horizontal member.

In an aspect of the invention, said support portion includes a top projection and a bottom projection, having aligned holes extending therethrough and a wedge securing member sized to pass through the aligned holes and a hole in said structural member of said scaffold post to secure said scaffold ledger to said scaffold post.

In yet a further aspect of the invention, the cover, in the working position is positioned above and covers said wedge securing member when extending through said aligned holes.

In a preferred aspect of the invention, said wedge securing member has a hook shaped end and each ledger head beneath said cover includes an engagement means shaped to engage the hook shaped end of the wedge securing member to selectively retain said wedge securing member in an initial clear position with the cover in the raised position.

In a preferred aspect of the invention, said cover is U-shaped having a top wall and two sidewalls and said engagement means is a bridge member extending between said two side walls. Preferably, each cover tapers inwardly towards a free end of said cover opposite a pivot axis of the cover.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
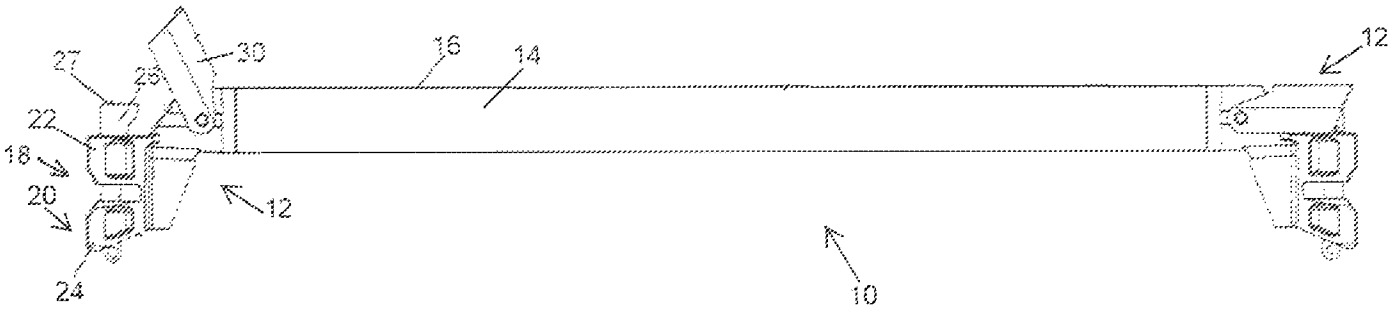
FIG. 1 is a side view of the scaffold ledger.

The scaffold ledger 10 shown in FIG. 1 includes the elongate structural member 14 connected to and located intermediate the opposed ledger heads 12. These ledger heads 12 are designed for connecting to rosette type fasteners secured on scaffold posts and located at predetermined spacings in the length of the scaffold post.

Figure 2:
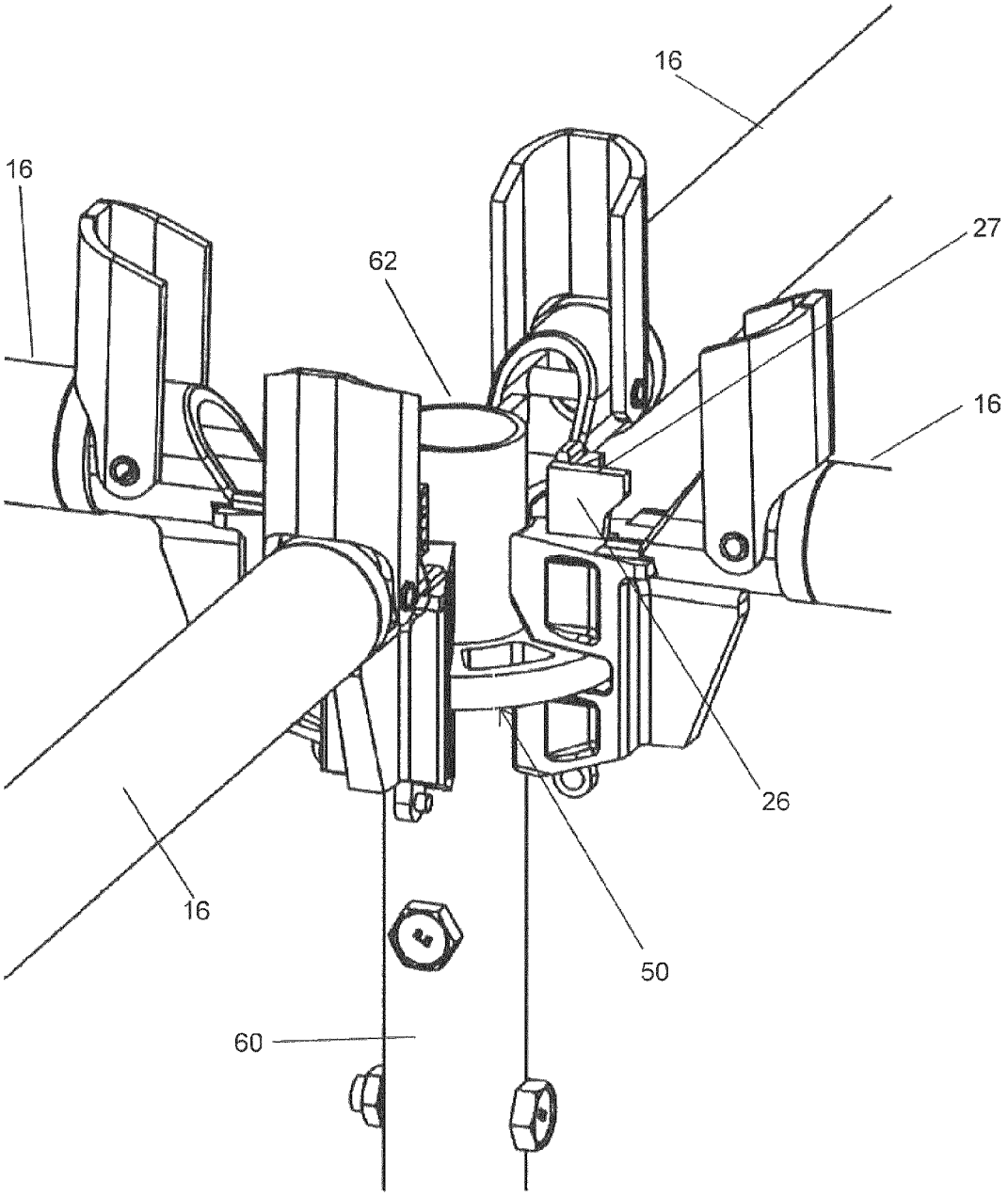
FIG. 2 is a partial perspective view showing four scaffold ledgers secured to a securing ring of a scaffold post.
Figure 3:
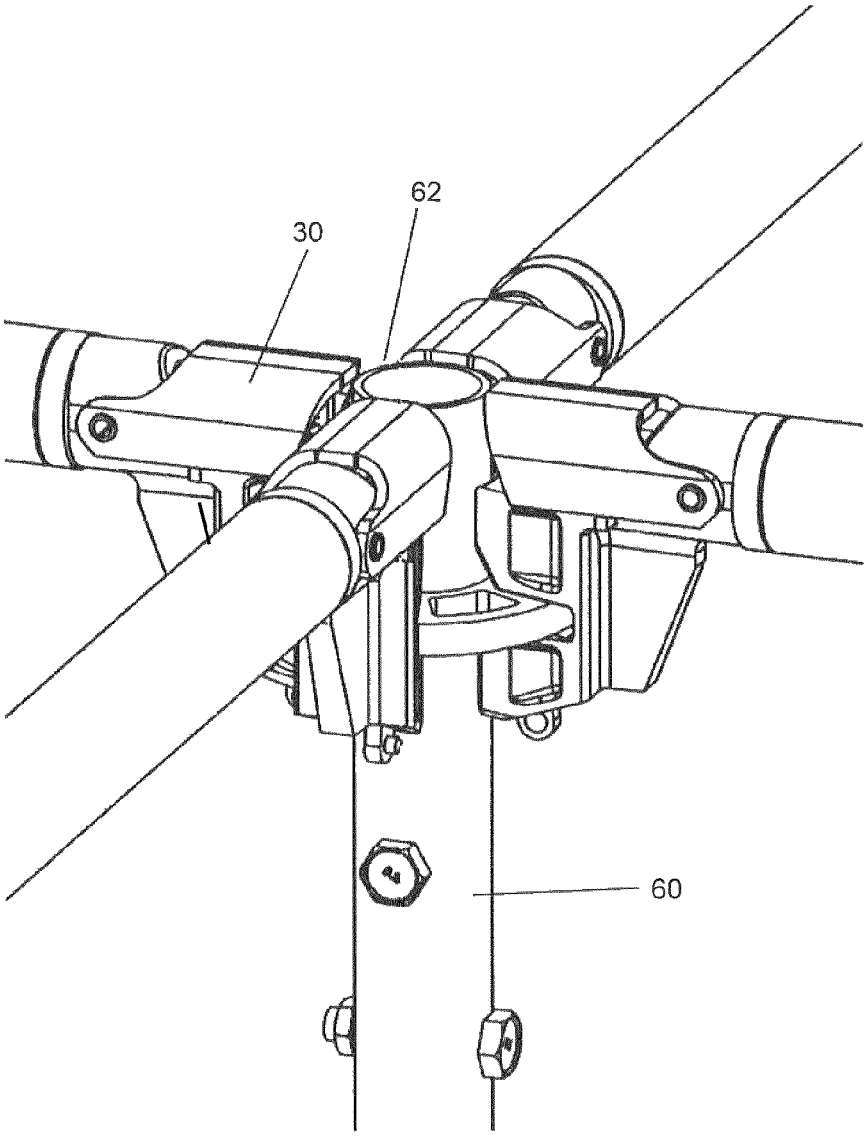
FIG. 3 is a partial perspective view similar to FIG. 2 with cover members of the ledger heads moved to a covered position.

Each ledger head 12 includes a projecting support member 18 for engaging a securing rosette 50 of a scaffold post 60 as shown in FIG. 1. The projecting support members 18 are downwardly offset relative to the elongate structural member 14. Each projecting support member 18 includes an upper portion 22 and a lower portion 24 as shown in FIGS. 10-13. Each ledger head 12 includes a securing slot 20 defined between the upper portion 22 and the lower portion 24 of the ledger head 12. The securing slot 22 allows placement of the ledger head on the securing rosette such that the upper portion 22 and the lower portion 24 are positioned either side of a securing recess of the securing rosette. The displaceable wedge 26 is movable between a clear position (with the wedge in the upper portion 22 above the securing slot) to a locked position. The wedge moves downwardly and passes through the upper portion of the ledger head and through a securing port of the securing rosette before being received in the lower portion 24 of the ledger head. Examples of a wedge in a locked position are shown in FIGS. 2 and 3. Once the displaceable wedge 26 has moved to the locked position as shown in FIG. 1, the movable cover flap 30 is positioned to overlie the head 27 of the displaceable wedge 26 and extend the top surface of the ledger head. This covered position is generally shown in FIG. 1 on the right hand side of the ledger 10.

The movable cover flap 30 covers the head 27 of the wedge 26 but also extends the upper surface 16 of the horizontal member 14 to essentially continue this upper surface over the length of the ledger between scaffold posts. As shown in FIG. 1, the ledger heads are adapted to engage the vertical faces of a scaffold post and the movable cover flaps 30 taper inwardly and terminate slightly short of connected scaffold posts. Ledger heads taper inwardly to allow more members to connect to a rosette.

Figure 5:
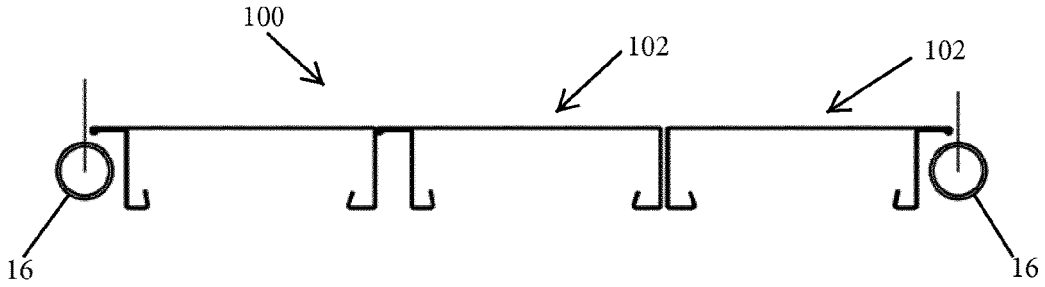
FIG. 5 is a side view of three scaffold planks and their relationship with ledger members that run parallel to the sides of the planks.

The elongate structural member 14 is positioned above the securing slot 20 and is vertically offset relative to the securing slots 20. The offsetting of the horizontal member in a manner as generally shown in the drawings, has advantages with respect to securing of scaffold planks on the ledgers when the ledgers are appropriately secured to scaffold posts. As shown in FIG. 5, it is possible to define a continuous work platform with a scaffold post located at an intermediate midpoint of the work surface. Basically, the work surface can pass over a lower intermediate scaffold post, if desired, as the offsetting of the elongate structural member locates the securing components below the top surface of the work platform.

A further advantage of offsetting the elongate structural member 14 is associated with the displaceable wedge 26. In a locked position as shown in FIG. 1, the upper edge 27 of the wedge will be below the upper surface 16 of the ledger.

There is also sufficient room to move the cover 30 to the covered position and thereby extend the upper surface of the ledger to reduce trip hazards. The upper portion of the wedge is covered and located below the upper surface 16.

In FIGS. 2 and 3, four ledgers are attached to a securing rosette with the upper surface of these ledgers generally being aligned with an upper surface of the scaffold post as shown in FIG. 3. This arrangement allows scaffold planks to be supported by the horizontal ledgers generally within the cells defined by adjacent supporting ledgers without substantial gaps in the resulting work platform defined by the supported scaffold planks. A cap type member can be provided over the exposed circular cavity of the scaffold post. The particular height of the cover member will depend on the level of the finished surface of the work platform. In some cases, the scaffold planks essentially nest within the cells defined between connected ledgers and a projecting flange of the scaffold planks can partially cover a ledger that is parallel to the edge of the scaffold plank. This type of relationship is shown in FIG. 5. Also shown is two planks, each covering approximately half of the common ledger positioned therebetween.

Figure 4:
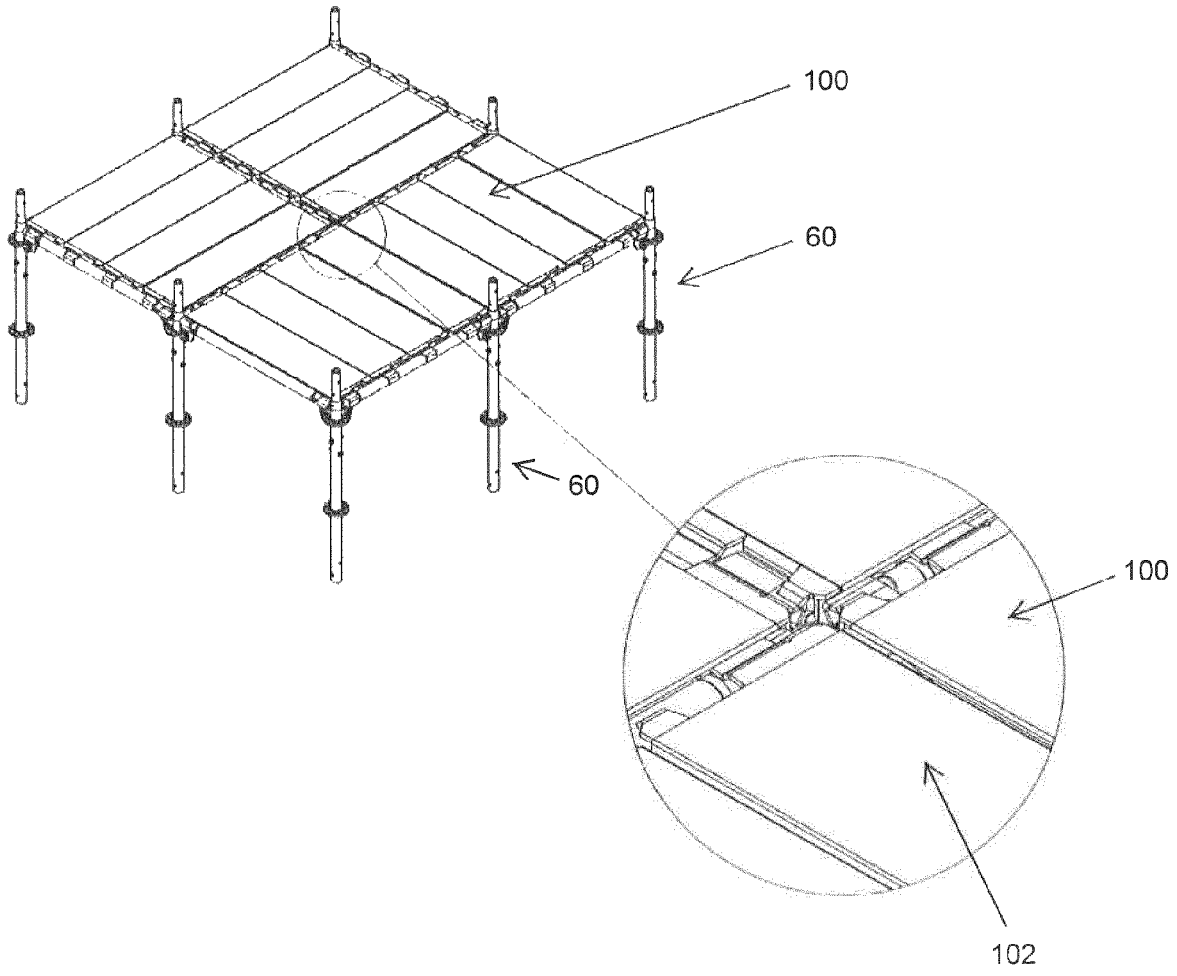
FIG. 4 is a partial perspective view of a work platform with a continuous work surface that passes over a scaffold post.

Preferably, the scaffold planks will include hook members at the end of the planks with the hook members designed to interfit (without interference) with the hook members of other scaffold planks. Planks can be supported on a common ledger in an end-to-end type manner as shown in FIG. 4.

In FIG. 2, the ledgers 10 are shown with the moveable cover flaps 30 at a raised position that is common when the ledgers are about to be secured to a securing rosette 50 of the scaffold post 60. Securing rosettes are located at predetermined modular positions in the length of the securing post as is well known in the industry. It can be seen that the scaffold post 60 has a top portion 62 that is essentially at the height of the upper surface 16 of the ledgers 10 when the ledgers are attached to the securing rosette. The upper portion 22 and the lower portion 24, of the ledger heads, engage a vertical face of the scaffold post and further improve the mechanical connection of the scaffold ledger to the scaffold post 60 by distributing forces over a larger area.

The securing rosettes 50 include a series of ports spaced about the circumference of the rosette exterior to the scaffold post 60 and the displaceable wedges 26 are adapted to engage any of these securing ports. As shown in FIG. 2, the wedge 26 of one of the ledgers 10 is shown in its engaged position and the top surface 27 of the wedge 26 is below the top portion 62 of the scaffold post 60 and below top surface 16 of the ledger.

Turning to FIG. 3, four ledgers 10 are secured to the scaffold post 60 and the displaceable covers 30 have all been moved to the covered position. In the covered position, the covers 30 form an extension of the top surface 16 and are generally aligned with the top portion 62 of the scaffold post 60. A further scaffold post can be inserted in the top portion 62 if further vertical support is required. For example, it may be appropriate to insert a post that is then used to form a guard rail as shown FIG. 9. The particular cooperation of the scaffold post 60 with the ledgers 10 having the offset elongate structural members 14, provides a number of advantages with respect to the flexibility of the scaffold system and the particular cooperation with removable scaffold planks. The offset elongate structural members 14 also cooperate with the scaffold post 60 having the rosette 50 adjacent the top portion 62 but downwardly therefrom, a sufficient distance, to securely cooperate with a ledger head.

FIG. 4 shows a work platform 100 visibly supported by eight scaffold posts 60, however, there is an intermediate scaffold post located at the center of the work platform 100. This intermediate scaffold post has its upper portion 62 covered or flush with the work platform 100 and the ledgers used to support the work platform 100, include ledgers extending to this intermediate scaffold post. The ledgers connect to a securing rosette at the end of the scaffold post, as described with respect to FIG. 3. Therefore, the system shown in FIG. 4 has essentially four cells with scaffold planks extending between opposed ledgers of the different cells. These scaffold planks can extend in either direction such that the ends of the scaffold planks are supported on a common ledger as illustrated in the upper two cells, or the ends of the scaffold planks can partially overlap a common ledger as shown in the lower two cells. The scaffold planks of the lower cell relative to the ledgers that are extending parallel to the scaffold planks, have the relationship as shown in FIG. 5. The adjacent cell with the scaffold planks orientated in the same orientation would have a projecting ledge of a scaffold plank overlapping the common ledger to essentially fully cover this common ledger. The enlarged detail of FIG. 4 shows how the common ledger is covered by the scaffold plank 102 in combination with the scaffold plank 104.

Figure 6:
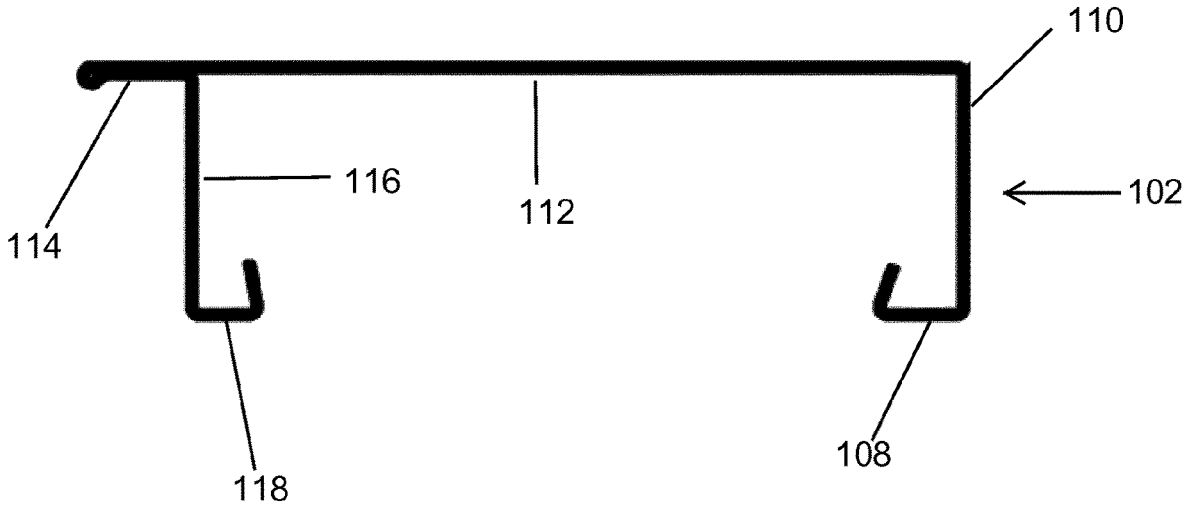
FIG. 6 is a sectional view of a single scaffold plank having a projecting edge on one side thereof.

A preferred body portion of the scaffold plank 102 is shown in cross section in FIG. 6. The body portion is preferably a rolled metal member having a rolled bottom edge 108, a generally vertical sidewall 110, a top surface 112, an extending overlapped flange 114, a downwardly extending wall 116 and a rolled bottom edge 118. The body portion typically includes a pattern or punched top surface to improve traction.

Hook members can be provided at opposite ends of the scaffold plank to allow the scaffold plank to be supported on a ledger with the top surface 112 slightly above the upper surface 116 of the ledgers. It is preferred that the scaffold planks partially nest in the cell defined by supporting ledgers, but it is possible for the scaffold planks to be supported above the ledgers. With the scaffold planks supported within a cell of the ledgers, the hook portions at the end of the scaffold plank can be offset in a manner to allow the planks to be supported on a common ledger in an end-to-end manner without interference.

Figure 7:
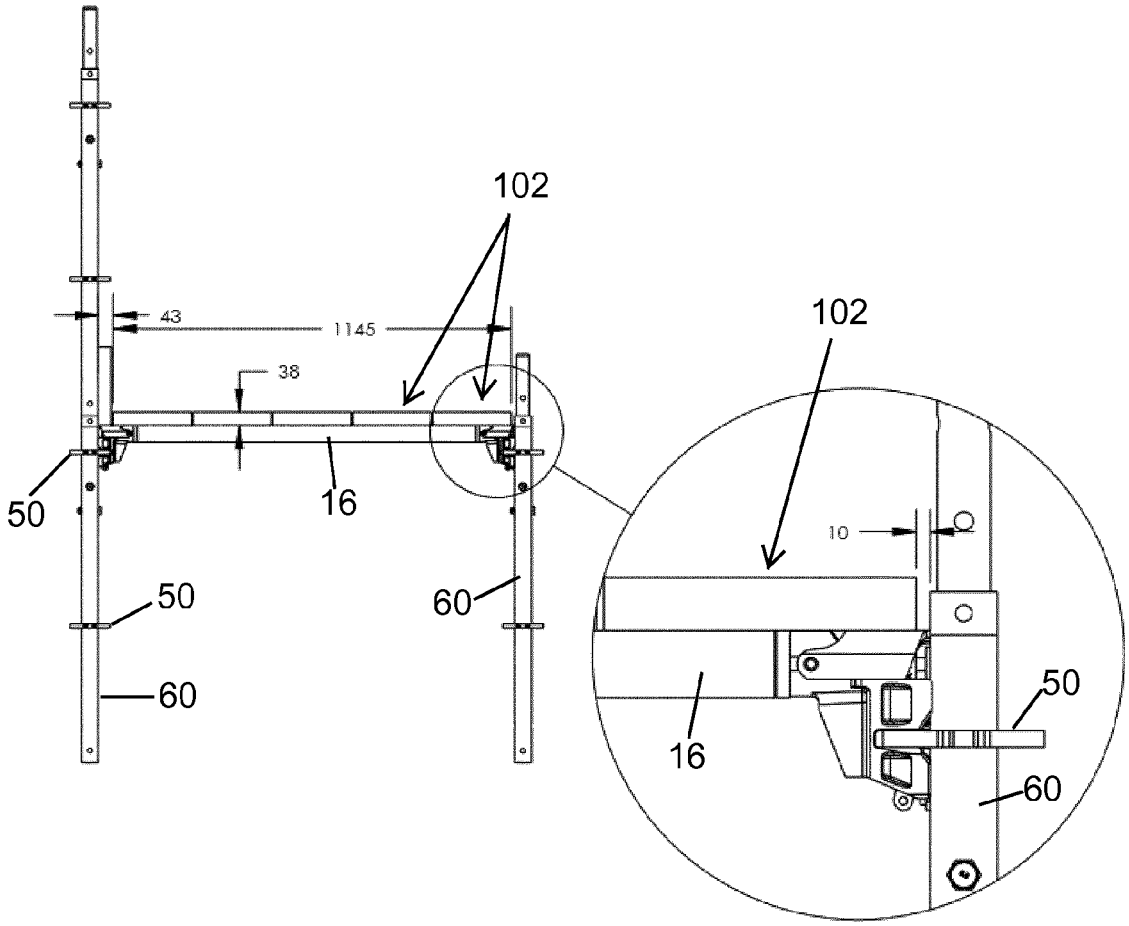
FIG. 7 is a side view showing a work platform supported by two scaffold post.

In FIG. 7, it can be seen that the scaffold planks are supported above the ledgers, however, the movable cover flaps allow the planks to extend to and be supported adjacent the scaffold posts.

Figure 8:
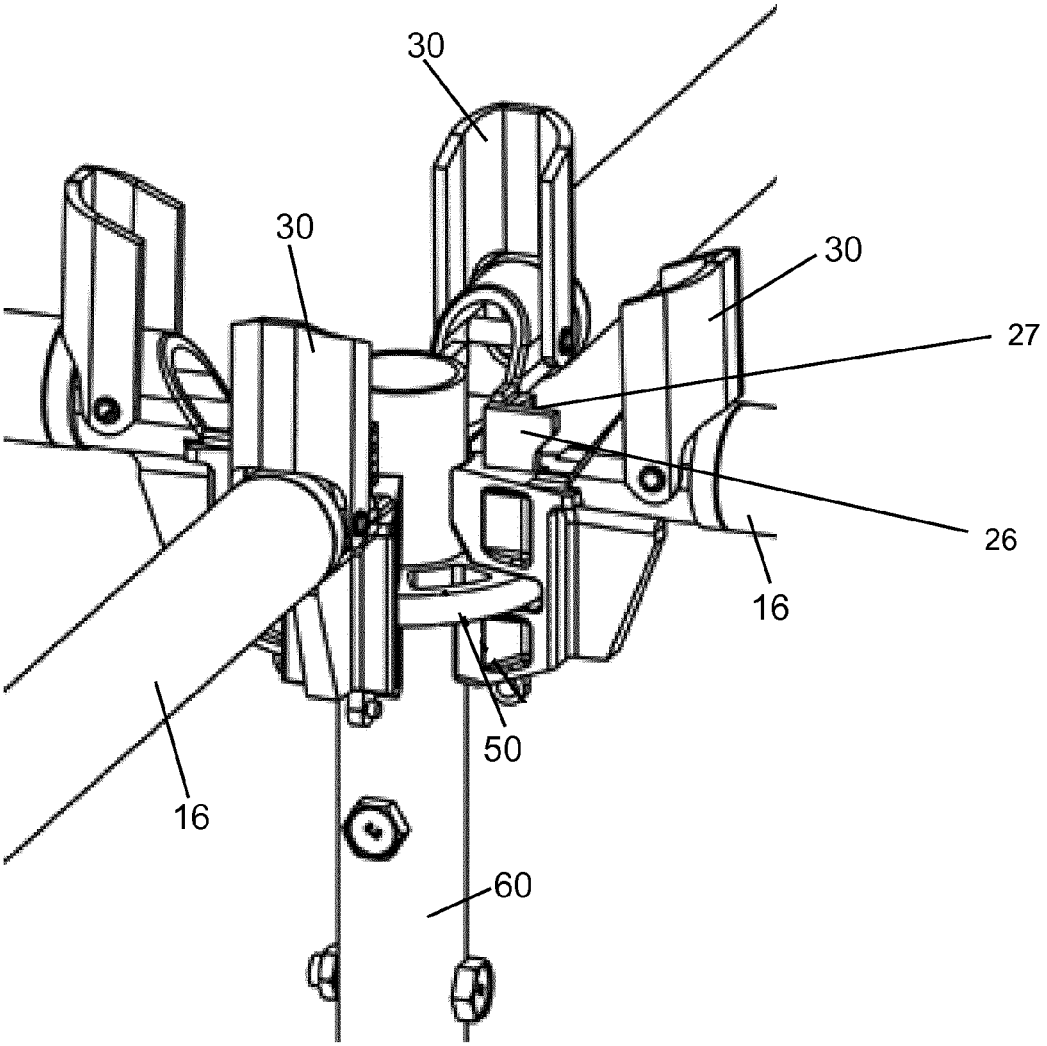
FIG. 8 is a partial perspective view showing four ledgers secured to a scaffold post with the covers in a raised position.

As shown in FIG. 8, the four ledgers are positioned 90° from each other and each engage a securing port of the securing rosette 50. The movable cover flaps 30 are in the open position to provide good access allowing the installer to locate the wedges in the rosettes and/or to assist the installer in removing of the wedges, if the system is being dismantled. As shown in the drawings, there is a gap between each of the ledgers with an exposed securing rosette port located in the gap. This allows a further ledger member to be secured on the securing rosette essentially at a 45° angle. Although a further horizontal ledger member can utilize this port, it is more common that a bracing member may utilize this connection. In any event, the securing rosette is capable of receiving and supporting multiple ledgers and/or brace members as may be required depending upon the particular install site particulars.

Figure 9:
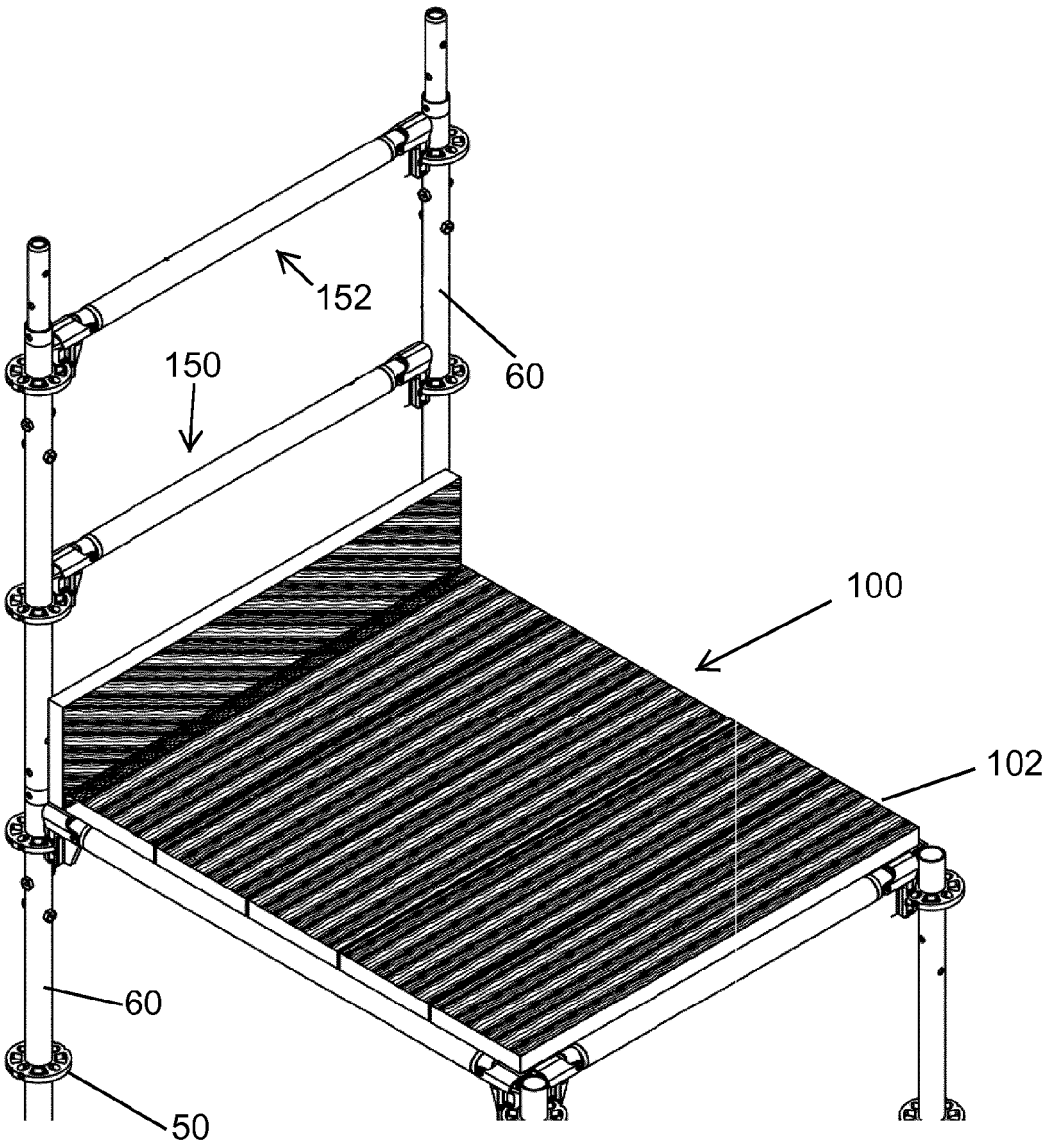
FIG. 9 is a partial perspective view of a work platform where two ledgers are used as guard rails at a raised position relative to the work platform.

A further advantage of the ledger is shown in FIG. 9. The ledgers 150 and 152 extend between two scaffold posts and engage the securing rosettes provided on the scaffold posts. The ledgers 150 and 152 form guard rails on one side of the work platform 100. The ledgers are secured by the displaceable wedge members with the cover flaps providing a safe top surface adjacent the scaffold posts. In the closed position of the cover flaps, the upper surface of the ledger is generally continuous between the scaffold posts. The securing structure of the wedge members and, particularly, the head portions of the wedge members are located below and protected by the cover flaps. With this arrangement, the wedge members do not present an exposed safety hazard to the workers. As can be appreciated, exposed and projecting wedges can present a hazard should a person fall and strike the ledger adjacent the wedges. With the offset of the elongate structural members and the covering of the heads of the wedges, an effective guard rail is realized.

FIGS. 10 through 15 show preferred structural elements of the ledger heads used in the present system. Each ledger head 12 has a rosette securing portion defined by the upper portion 22, the lower portion 24 and the securing slot 20. The upper portion and lower portion project from a rear face 28. A diagonal structural member 40 extends inwardly and upwardly from the rearface 28 to support the connecting portion 42 that is shaped to engage and connect with the elongate structural member 14. Depending upon the particular system, the structural member 14 is preferably an elongate tube, however, other shapes and cross sections can be used. Inverted "T" shaped structural members 14 are known where the scaffold planks essentially rest on a bottom flange of the inverted T-member. Channel sections are also known where the scaffold planks can hook into the channel. The preferred structure is the tube as shown and previously described.

Immediately above the diagonal structural member 40 and spaced inwardly from the back face 28, is a pair of support walls 35 for pivotally securing the movable cover flap 30 via the pin 37. The support structure 35 cooperates in defining a retaining arrangement for maintaining the displaceable wedge 26 in a clear position as shown. This clear position has a tip portion 41 of the wedge 26 retained in the upper portion 22, however, the securing slot 20 is clear to allow the ledger head to receive and engage a securing rosette. The support walls 35 define a slot therebetween to accommodate movement of the wedge.

Figure 13:
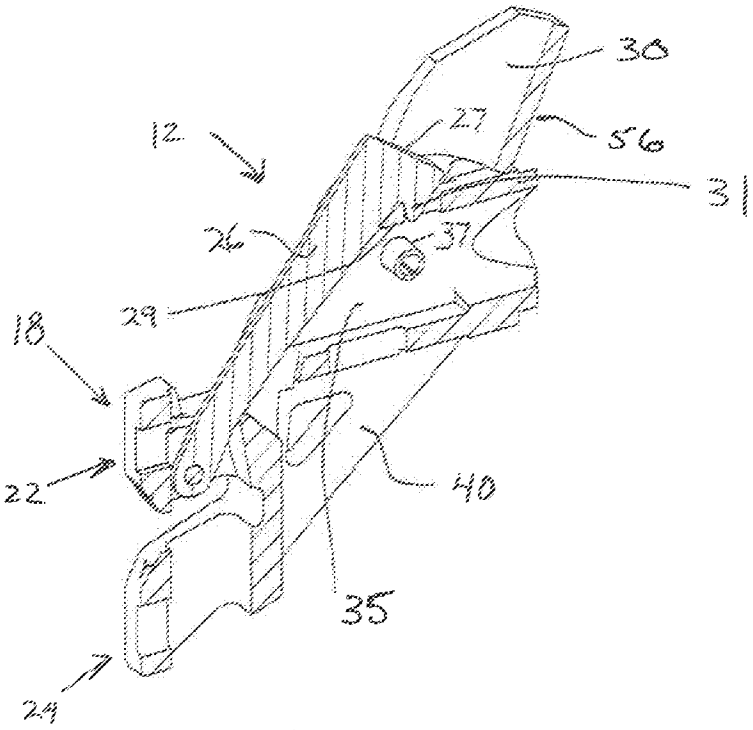
FIG. 13 is a perspective section view of the ledger head similar to FIG. 12.
Figure 12:
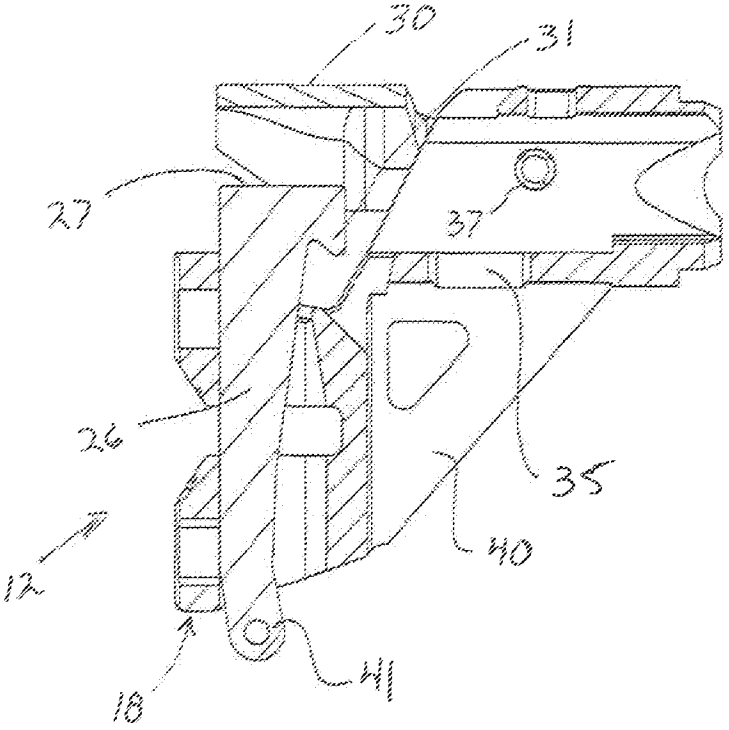
FIG. 12 is a vertical sectional view of the ledger head with the wedge in an engaged position.

As shown in the cross sectional view of FIG. 13, the displaceable wedge 26, at the upper free end thereof, includes a downwardly extending hook 31 that cooperates with the horizontally extending bridge member 29 of the ledger head that is connected to and extends between support walls 35. This hook and bridge arrangement allows the displaceable wedge to be maintained in the clear position in preparation for movement of the wedge to an engaged position. With the wedge in the clear position as shown in FIG. 13, the cover is also in the upright position. The bridge and hook provide a convenient arrangement for maintaining the wedge in the clear position. Without this arrangement, the wedge, due to its angled position in the clear position, would tend to move towards the locked position making installation more difficult. The wedge in the locked position is at an angle of about 45° from horizontal. Preferably, the bridge member 29 includes a port or recess in the upper surface thereof sized to provide a gravity latch of the hook 31 with the port or recess.

Figure 11:
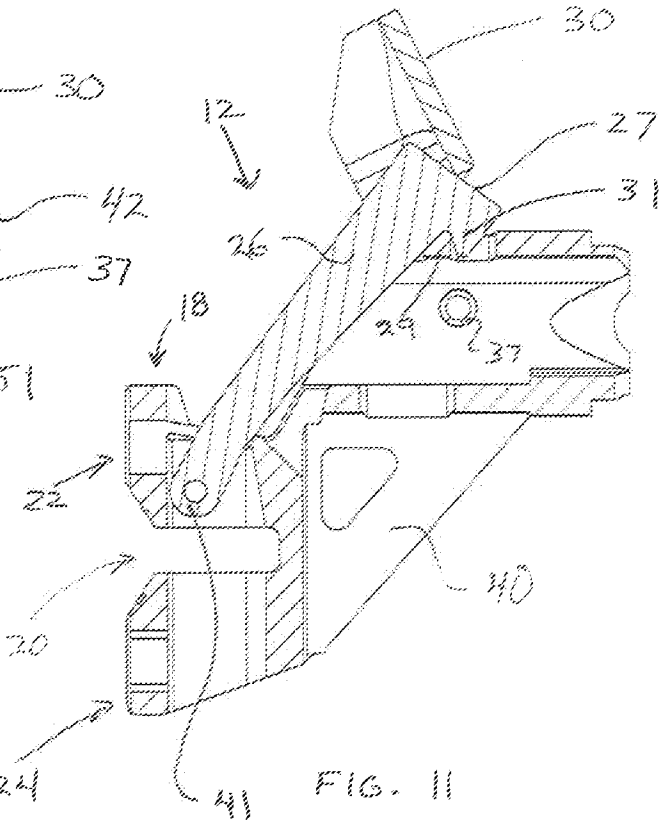
FIG. 11 is a sectional view through the ledger head of FIG. 10 showing the structure for retaining the fastening wedge in a raised position.
Figure 14:
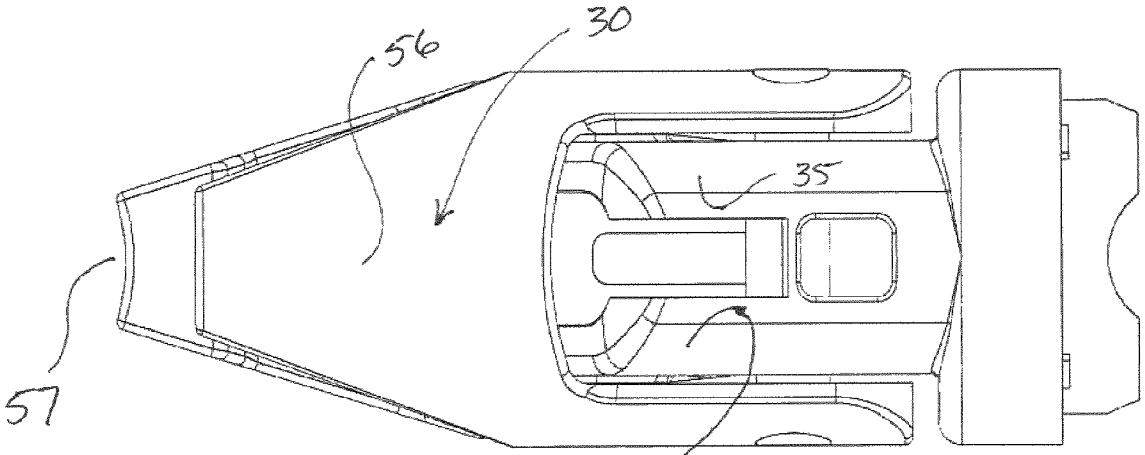
FIG. 14 is a top view of the ledger head with the cover moved to a cover position.
Figure 15:
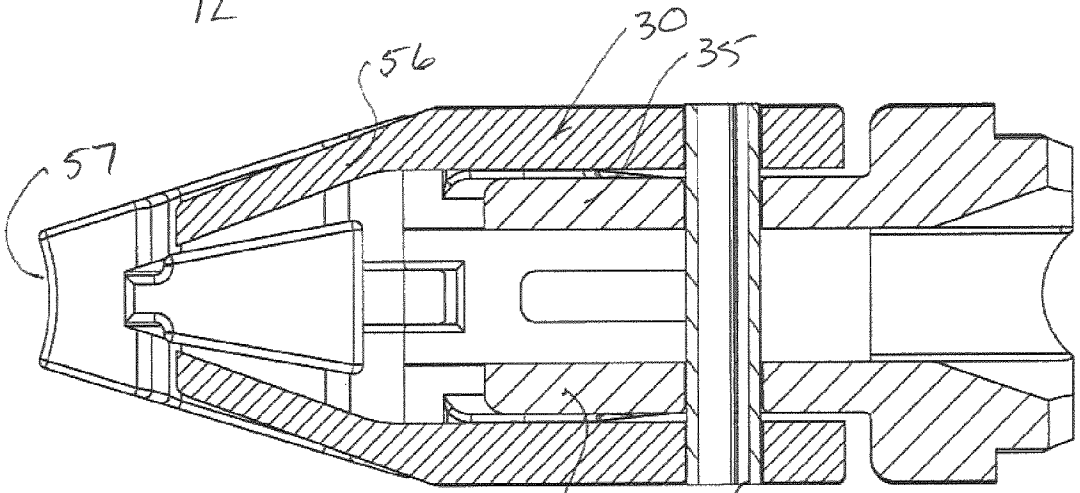
FIG. 15 is a horizontal sectional view through the pivot pin of the cover.

In FIG. 14, it can be seen that the cover includes a front portion 56 designed to cover the top of the wedge and portion 56 stops short of the front edge of the securing post engaging face 57. This engaging face 57 is on the upper portion 22 and the lower portion 24. The cover has a cutout portion 59 with the sides adjacent the cutout portion still providing horizontal support generally aligned with the upper surface of the horizontal member. This cutout portion 59 allows the cover to be rotated rearwardly beyond the 90° orientation to an angle of perhaps 135° as shown in FIG. 11. This further movement of the cover provides good access to the wedge as shown in FIG. 11 and provides good clearance at the end of the ledger heads to simplify installation.

Figure 10:
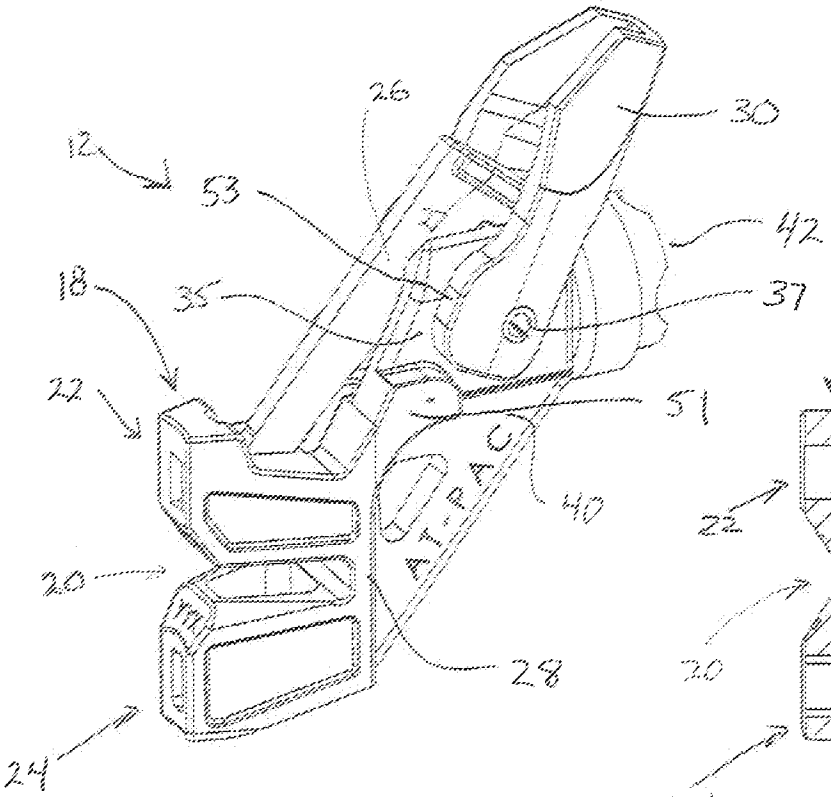
FIG. 10 is a front perspective view of a preferred ledger head.

The cover flap 30, as shown in FIG. 10, includes a base support 53 that abuts with support lug 51 to provide a force transfer mechanism allowing cover flap 30 to act as a support surface. Each cover flap tapers inwardly providing a narrow nose as shown towards the free end of the cover flap located opposite the pivot axis of the cover flaps. This allows for good coverage in the closed position while allowing other structural members to engage the rosette of the scaffold posts. In the closed or cover position of the cover flap (FIG. 12), the top of the wedge securing member 26 is spaced below the cover flap and below a top surface of the ledger.

The modified ledger cooperates with a scaffold post in a particular manner and the movable cover provides a number of advantages over prior art systems particularly with respect to safety. Furthermore, the modified ledger can also be used in the guard rail function without presenting a significant hazard at the connection point to a scaffold post.

Although various preferred embodiments of the present invention have been described herein in detail, it will be appreciated by those skilled in the art that variations may be made thereto without departing from the scope of the appended claims.

The embodiments of the invention in which an exclusive property or privilege is claimed are defined as follows:

1. A scaffold ledger comprises two ledger heads located at opposite ends of an elongate structural member extending axially between and being mechanically secured to each ledger head;

each ledger head includes a projecting support member for engaging a securing member of a scaffold post and said projecting support member is downwardly offset relative to said elongate structural member;

an upwardly angled rear support member of the ledger head connects with said elongate structural member at a position axially inwardly of said projecting support member;

wherein each ledger head includes a pivoting cover cap movable from a first position extending a top surface of said elongate structural member over said projecting support member to a raised position providing top access to said projecting support member, wherein the pivoting cover cap extends between a first end and a second end thereof, the first end is pivotably coupled above the upwardly angled rear support member of the ledger head, and the second end is spaced apart from the first end such that, when the pivoting cover cap is in the first position, the second end is located axially distal from the elongate structural member and axially proximate the projecting support member.

2. The scaffold ledger of claim 1, wherein each ledger head includes a displaceable wedge moving from a raised clear position allowing positioning of the scaffold ledger for engaging the scaffold post to a locked position extending through said ledger head to retain said ledger head on the scaffold post with a top drive surface of said wedge below an upper surface of said elongate structural member.

3. The scaffold ledger of claim 1, wherein the pivoting cover cap includes a base support that abuts the ledger head to transfer force between the pivoting cover cap and the ledger head when the pivoting cover cap is in the first position.

4. The scaffold ledger of claim 1, wherein the rear support member includes a first support wall and a second support wall spaced apart from the support wall to define an axially extending slot therebetween and the pivoting cover cap is pivotably coupled with the first support wall and the second support wall via a pin.

5. The scaffold ledger of claim 4, wherein each ledger head includes a displaceable wedge moving from a raised clear position allowing positioning of the scaffold ledger for engaging the scaffold post to a locked position extending through said ledger head to retain said ledger head on the scaffold post with a top drive surface of said wedge below an upper surface of said elongate member.

6. The scaffold ledger of claim 5, wherein the axially extending slot defined by the first support wall and the second support wall is sized to allow the displaceable wedge to move in the slot.

7. The scaffold ledger of claim 5, wherein each displaceable wedge has a hook shaped end and said ledger head beneath said cover includes an engagement means shaped to engage the hook shaped end of the displaceable wedge to selectively retain said displaceable wedge in an initial clear position with the cover in the first position.

8. The scaffold ledger of claim 7, wherein the pivoting cover cap is U-shaped having a top wall and two sidewalls and the engagement means is a bridge member extending between the two side walls.

9. A scaffold ledger comprising two ledger heads located at opposite ends of an elongate horizontal member extending between and being mechanically secured to each ledger head;

each ledger head comprising, a support portion for coupling to a structural member of a scaffold post;

a body extending inwardly and upwardly from said support portion coupling one end of said horizontal member at a position above said support portion; and a pivoting cover movable between a raised position providing top access to said support portion and a working position wherein a top surface of said cover is generally aligned with a top surface of said horizontal member, wherein said support portion includes a top projection and a bottom projection, having aligned holes extending therethrough and a wedge securing member sized to pass through the aligned holes and a hole in said structural member of said scaffold post to secure said scaffold ledger to said scaffold post, wherein, in the working position, said cover is positioned above and covers said wedge securing member when extending through said aligned holes, wherein said wedge securing member has a hook shaped end and said ledger head beneath said cover includes an engagement means shaped to engage the hook shaped end of the wedge securing member to selectively retain said wedge securing member in an initial clear position with the cover in the raised position.

10. The scaffold ledger of claim 9, wherein said cover is U-shaped having a top wall and two sidewalls and said engagement means is a bridge member extending between said two side walls.

11. The scaffold ledger of claim 9, wherein each cover tapers inwardly towards a free end of said cover opposite a pivot axis of the cover.

12. The scaffold ledger of claim 9, wherein the pivoting cover extends between a first end and a second end thereof, the first end is pivotably coupled with the body of the ledger head, and the second end is spaced apart from the first end such that the second end is located away from the elongate horizontal member and toward the scaffold post when the pivoting cover is in the working position.

* * * * *